US007182582B2

(12) United States Patent
Bresolin et al.

(10) Patent No.: US 7,182,582 B2
(45) Date of Patent: Feb. 27, 2007

(54) CENTRIFUGAL PUMP WITH REVERSE ROTATION PROTECTION INTEGRATED ON THE IMPELLER BLADE

(75) Inventors: Valerio Bresolin, Pove del Grappa (IT); Giancarlo Baron, Romano d'Ezzelino (IT)

(73) Assignee: Hydor SRL, Vicenza (IT)

( * ) Notice: Subject to any disclaimer, the term of this patent is extended or adjusted under 35 U.S.C. 154(b) by 489 days.

(21) Appl. No.: 10/492,587

(22) PCT Filed: Mar. 27, 2003

(86) PCT No.: PCT/IT03/00180

§ 371 (c)(1),
(2), (4) Date: Apr. 15, 2004

(87) PCT Pub. No.: WO03/083312

PCT Pub. Date: Oct. 9, 2003

(65) Prior Publication Data

US 2004/0265122 A1 Dec. 30, 2004

(30) Foreign Application Priority Data

Apr. 3, 2002 (IT) ..... VE2002A0014

(51) Int. Cl.
*F04B 49/00* (2006.01)

(52) U.S. Cl. ..... 417/223; 416/236 R; 416/236 A

(58) Field of Classification Search ..... 417/423.3, 417/214; 416/183, 185, 223 B, 237, 236 R, 416/236 A, 235
See application file for complete search history.

(56) References Cited

U.S. PATENT DOCUMENTS 6,524,078 B1 * 2/2003 Brooks et al. ..... 417/223
7,040,860 B2 * 5/2006 Newman et al. ..... 415/123

FOREIGN PATENT DOCUMENTS

EP 0 383 464 A2 8/1990
EP 1 074 744 A2 2/2001

OTHER PUBLICATIONS

International Search Report of the corresponding international publication, completed Jul. 29, 2003, by P. Ingelbrecht, at Rijswijk, and mailed Apr. 8, 2003.

* cited by examiner

*Primary Examiner*—Ehud Gartenberg
*Assistant Examiner*—Vikansha Dwivedi
(74) *Attorney, Agent, or Firm*—Griffin & Szipl, P.C.

(57) ABSTRACT

In a centrifugal pump (10) for liquids comprising an impeller casing (50) inside which a centrifugal impeller (40) is rotatably mounted including a hub (42) from which a plurality of curved blades (44) delimited by two curved edges (44*a*,44*b*) extend, from one of the curved edges (44*a*) of the curved blades (44) a tab (48) extends on the side of the concavity of the blades (44) and is folded in the opposite direction to the blade (44) with respect to a radial plane.

21 Claims, 2 Drawing Sheets

CENTRIFUGAL PUMP WITH REVERSE ROTATION PROTECTION INTEGRATED ON THE IMPELLER BLADE

This is a National Phase Application in the United States of International Patent Application No. PCT/IT03/00180 filed Mar. 27, 2003, which claims priority on Italian Patent Application No. VE2002A000014, filed Apr. 3, 2002. The entire disclosures of the above patent applications are hereby incorporated by reference.

FIELD OF THE INVENTION

The present invention relates to a centrifugal pump for liquids with an impeller having curved blades, used for example in aquariums, in the food industry, in fountains and the like.

BACKGROUND OF THE INVENTION

The pumps of this type comprise a centrifugal impeller made of a hub from which a plurality of blades having a curved shape extend. The centrifugal impeller is coupled to an electric synchronous motor contained inside a motor casing which is sealed in order to prevent water from entering inside, thus damaging the motor. The electric synchronous motor comprises a stator made of an electromagnet and a rotor formed by a permanent magnet which is integrally and axially coupled to the centrifugal pump. The centrifugal pump is housed inside an impeller casing which has a cylindrical shape defined bye a cylindrical wall and two circular side walls: a first circular side wall wherein a suction intake for the liquid to be pumped is made in the axial position and a second circular side wall defined by the motor casing. An outlet for the liquid is made in the cylindrical wall.

The impellers with curved blades are unidirectional, that is they have a predetermined rotating direction for a correct functioning, unlike impellers with straight and radial blades which are bidirectional. In fact, the latter have a symmetrical-axial impeller and, then, the rotating direction has no effect on the functioning of the pump.

As stated above, the centrifugal pumps are coupled to an electric synchronous motor which, as it is known, may start indifferently in one direction or in the opposite direction. Therefore, it is evident that, in case of impellers having curved blades, there are good chances that the pump begins to rotate in the wrong direction, thus preventing the pump from functioning or even starting.

Therefore, for the above-mentioned applications, impellers with straight blades are used. However these impellers have a low efficiency.

In the case of impellers with curved blades, different solutions have been adopted in order to always allow a correct starting of the pump, such as to make the free ends of the blades of the impeller with flexible materials which can be folded only in one direction, thus allowing a correct starting of the pump.

Although, these and other solutions are efficient, they significantly increase the cost of the product, above all, in consideration of the fact that the elements involved are small or even very small, any constructive complication negatively affects on the production time and then on the final cost.

Another aspect to be considered is due to the fact that such solutions may reduce the proper functioning of the pump, so causing losses of the liquid to be pumped and then to diminish the total efficiency of the same, that in pumps so small is already low.

It is evident that the low efficiency of a pump, with straight or curved blades, forces the dimension of the impeller to increase, and also the dimension of the electrical motor coupled to it; since it is necessary to have an oversized motor, the dimension of electro-pumps become remarkable.

Since the pumps are used in applications wherein the overall dimension has to be restricted, both due to the available space but, above all, in order to avoid a negative visual impact, the dimension of electro-pumps is an important characteristic, if not the main one.

SUMMARY OF THE INVENTION

Therefore, the aim of the present invention is to construct a centrifugal pump with curved baldes in which the efficiency is significantly increased with respect to those of the prior art.

In such a way, not only the centrifugal impeller is smaller with respect to those of the prior art having the same performance, but it also requires an electric motor with reduced power and then with inferior dimension.

In conclusion, the electro-pump has restricted dimension if compared with the dimension of other electro-pumps of the same type and performance, so as to be advantageously used for example in aquariums and fountains, where the overall dimension of the product represents the main characteristic in choosing the product.

This aim is reached by a centrifugal pump for liquids of the initially described type, that is a centrifugal pump comprising an impeller chamber inside which a centrifugal impeller is rotatably mounted, said centrifugal impeller includes a hub from which a plurality of curved blades extends out, each of them delimited by two curved edges, said impeller chamber being defined by two circular side walls and a cylindrical wall, on one of said circular side walls and in an axial position there is a suction intake for the liquid to be pumped while, on the cylindrical wall there is an outlet for the liquid, characterized in that a tab extends from one curved edge of said curved blades on the side of the concavity of the blades and folded in the direction opposite to the blade with respect to a radial plane.

In so doing, the starting of the synchronous electric motor, in the direction in which the pump does not work, is avoided since the folded tabs would hit the uni-directional stopping element, thus stopping the movement. Therefore, the motor can only be started in the opposite direction, that is, the one corresponding to the correct direction of the functioning of the pump since the tabs overtake the uni-directional stopping element.

Moreover, because of the particular shape of the impeller, namely due to the folded tabs, the liquid which flows inside the impeller is channelled more regularly and uniformly; this reduce the inevitable turbulences which originate between the blades of the centrifugal impeller. As it is known, above all in pumps of very small dimensions and having a reduced head and flow, a considerable amount of the power required by the pumps is dissipated in the turbulent and whirling motions which the impeller creates during its usual functioning.

With the pump of the present invention, since the impeller is able to direct the liquid in an optimum way, the turbulent and whirling motions are significantly reduced and, then, the hydraulic losses, which are responsible for the most part of the dissipation of the energy given to the liquid, are remarkably reduced.

The present centrifugal impeller is made with reduced dimensions if compared with pumps of the prior art of the same performance and, since it requires less power, smaller electric motors are used, therefore the entire electro-pump is compact.

The construction of this impeller does not involve difficulties, since it can be constructed with the same processes used to build the impellers of the prior art, and without introducing further construction phases.

In particular the centrifugal pump comprises adjusting means for the liquid flow in order to regulate the amount of liquid which comes out from said outlet, means which comprise a cylindrical tang rotatably mounted inside said cylindrical wall of said impeller chamber, said cylindrical tang having at least one opening so that when said cylindrical tang or said cylindrical wall rotate, the supply liquid is regulated from a maximum value when the opening of said cylindrical tang is positioned at the outlet made in said cylindrical wall, to a zero value when the cylindrical tang completely closes the outlet.

In such a way, according to the specific request, it is possible to regulate the flow of liquid supplied by the pump, thus avoiding undesiderable losses but, above all, making it possible to use the pump in different applications, furthermore avoiding the construction of different pumps with different flows.

BRIEF DESCRIPTION OF THE DRAWINGS

These and other advantages of the present invention will be more evident from the following detailed description given for an exemplifying and not limitative purpose, with reference to the subsequent enclosed drawings, wherein.

DETAILED DESCRIPTION OF THE ILLUSTRATIVE EMBODIMENTS

Figure 1:
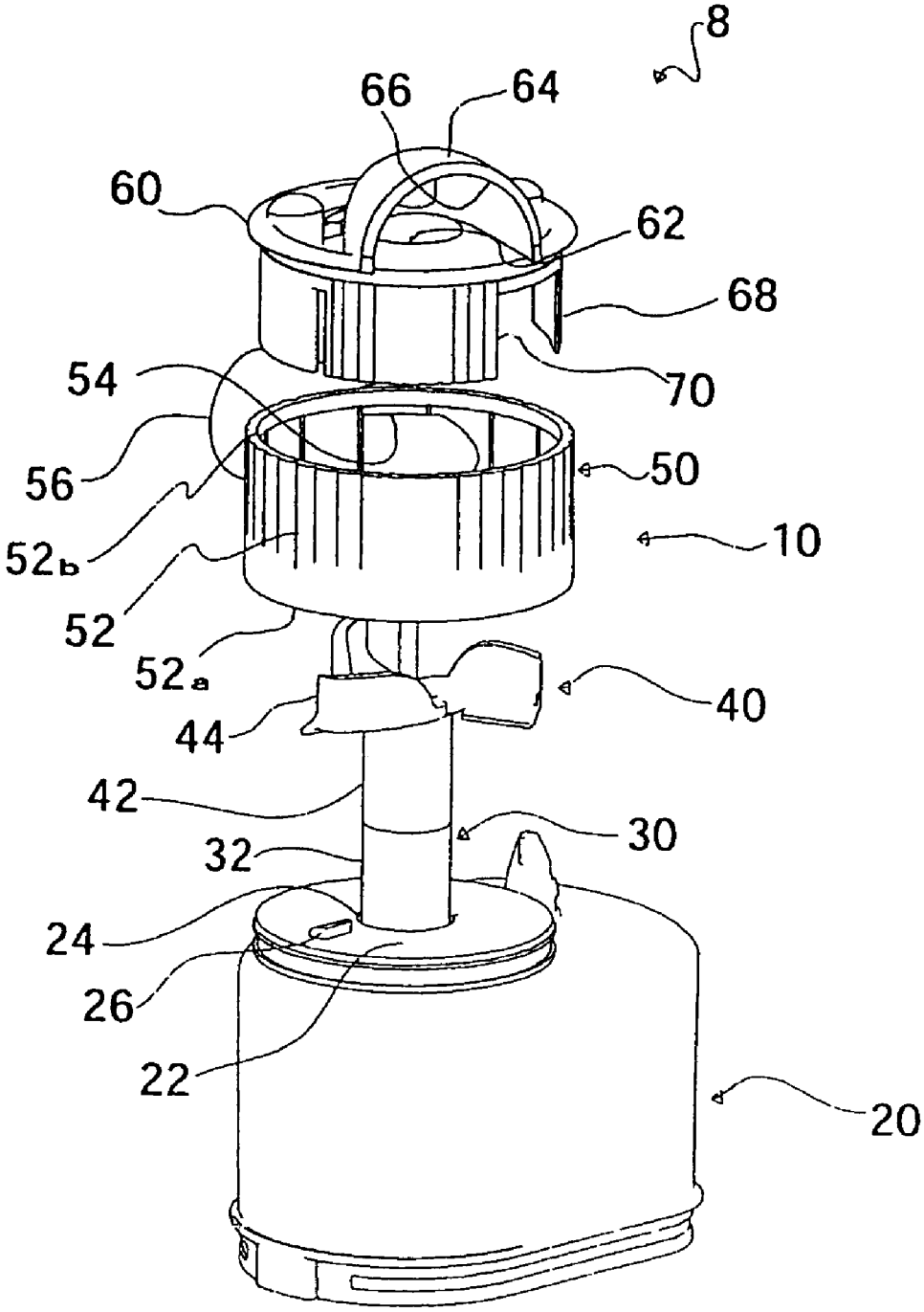
FIG. 1 is a three-dimensional exploded view of an electro-pump which comprises a centrifugal pump according to the present invention.

In FIG. 1 an electro-pump for liquids, preferably water, which is used for example in aquariums, fountains, in food industries, or in other fields, is entirely indicated with reference 8. The electro-pump 8 comprises a centrifugal pump 10 coupled to an electric synchronous motor 30 contained inside a motor casing 20.

The motor casing 20 is a box-like element which contains inside the electric motor 30 in a sealed water manner in order to prevent water from going inside.

The synchronous electric motor 30 comprises a stator (not visible in figures) made up of an electromagnet which works as an inductor and a rotor 32 made up of a permanent magnet which works as an armature.

The centrifugal pump 10 comprises a centrifugal impeller 40 contained in an impeller chamber or volute 50. The centrifugal pump 40 comprises a hub 42 on which a plurality of blades 44 with a curved profile are fixed. The motor or the permanent magnet 32 is axially and securely coupled to the hub 32 of the centrifugal impeller 40.

The impeller chamber 50 comprises a cover 60 and a cylindrical wall 52 delimited by a first circular edge 52*a* and a second circular edge 52*b*. The cylindrical wall 52 is rotatably mounted on the motor casing 20 by fixing the first circular edge 52*a* to a circular wall 22 made on the motor casing 20. The cover 60 is rotatably mounted on the cylindrical wall 52 at the second circular edge 52*b*.

An essentially circular opening 24 is made on the circular wall 22 of the motor casing 20, from which the hub 42 of the centrifugal impeller comes out.

Figure 2:
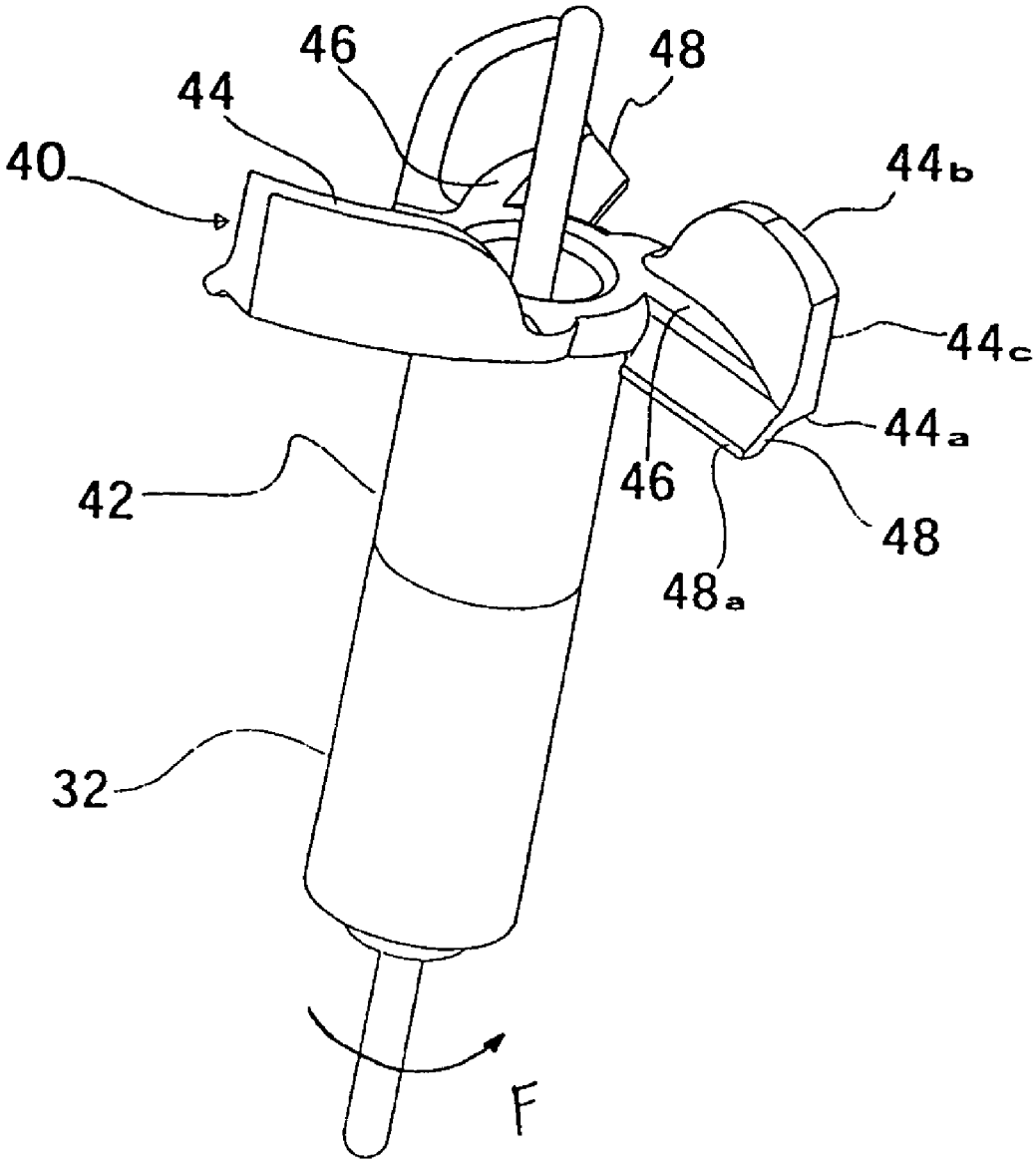
FIG. 2 is a three-dimensional view of the impeller of the centrifugal pump of FIG. 1.

Turning now to the centrifugal impeller 40, as better represented in FIG. 2, it can be noted that three identical blades 44 with a curved profile are fixed to the hub 42. Each blade 44 is defined by two curved and parallel edges 44*a*,44*b* which extend from the hub 42 and by an end edge 44*c*. A radial tab 46 extends from the curved edge 44*a* of each blade 44 and on the side of the concavity of the blades 44.

The radial tab 46 has an end edge which joins the hub 42 with the free end of the curved profile 44*a* and from which a tab 48 extends out folded in the opposite direction with respect to the blade. The free end 48*a* of the folded tabs 48 is close to the circular wall 22 of the motor casing 20, so that during the rotation of the centrifugal impeller 40, the free edge 48*a* passes very near to the circular wall 22.

A uni-directional stopping element 26 is made on the circular wall 22 and interacts with the folded tabs 48. The unidirectional stopping element 26 consists of a projecting element delimited, from one side, by a profile which gradually rises with respect to the circular wall 22 and, on the opposite side, by a profile essentially right-angled with respect to the circular wall 22, so that as the centrifugal impeller 40 rotates in the direction indicated by the arrow F of FIG. 2, namely when the free edge 48*a* of the folded tabs 48 interacts with the gradually rising profile of the stopping element 26, the centrifugal impeller 40 is free to rotate, whereas a rotation in the opposite direction is prevented since the free edge 48*a* of the folded tabs interacts with the right-angled profile of the stopping element 26.

The centrifugal impeller 40 may only rotate in the direction of the arrow F, that is with the convex profile which presses on the liquid and then in the correct direction of its functioning.

In particular, the assembly of the rotor 32 and the centrifugal impeller 40 are mounted on the electro-pump 8 with a prefixed axial gap, so that slight axial movements with respect to the impeller chamber 50 may occur to the centrifugal impeller 40, as well as to the rotor 32 inside the motor casing 20.

In the rest position, wherein the electric motor 30 is off and the centrifugal impeller 40 is stopped, due to the residual magnetism, the rotor 32 is centrally positioned with respect to the stator. In this situation, the folded tabs 48 are in contact with the circular wall 22 of the motor casing 20, thus assuring the correct starting of the centrifugal pump 10. Whereas, when the electric motor 30 is started, the centrifugal impeller 40 begins to rotate in the correct direction, indicated by the arrow F, but the hydrodynamic thrust which acts on the folded tabs 48, due to the fact the tabs are folded, has an axial component directed to the opposite side of the circular wall 22 of the motor casing 20.

Due to the existing gap between the centrifugal impeller 40 and the impeller chamber 50, the centrifugal impeller 40 moves slightly away from the circular wall 22 of the motor casing 20, so as to avoid any contact between the folded tabs 48 and the uni-directional stopping element 26. Therefore, the mechanical losses due to the continuous contact between the folded tabs 48 with the circular wall 22 are eliminated.

From FIG. 1, it can be noted that an opening 54 is made in the cylindrical wall 52 which represents the outlet for the liquid and is connected to a cylindrical duct 56.

A hole 62 is made in the central position of the cover 60, so as to form the suction intake of the liquid. A cup 64 is mounted on the cover 60 which covers the hole 62 and, then, the suction intake, which has an opening 66 radially arranged so that, while the cover 60 rotates, the orientation of the suction flow of the liquid changes.

The cover 60 has a cylindrical tag 68 designed to be rotatably inserted inside the cylindrical wall 52. Openings 70 are made on the tag 68 so that, as the cover 60 rotates, and then also the cylindrical tag 68, with respect to the cylindrical wall 52, the flow of the supply liquid is regulated from a maximum value, when the opening 70 of the cylindrical tag 68 is positioned at the outlet 54, to a zero value when the cylindrical tag 68 completely closes the outlet 54. In so doing, it is possible to regulate the amount of liquid supplied by the centrifugal pump 10.

In particular, three openings 70 are made in the cylindrical tag 68 which are essentially arranged at 90° one respect to the other so that, by rotating the cover 60 with respect to the cylindrical wall 52, the direction of the suction flow is oriented at 0°, 90° or 270°, 180° with respect to the direction of the supply flow. It is clear that in each of these three position the supply flow is regulated by slightly rotating the cover 60 with respect to the cylindrical wall 52.

Furthermore, since the cylindrical wall 62 is rotatable with respect to the motor casing 20, it is possible to rotate the motor casing 20 positioning it in the suitable maimer, maintaining the same orientation for the supply flow and the same amount of the liquid supplied.

Thanks to the present invention, wherein the starting of the centrifugal pump occurs always in the correct direction and the rotation in the opposite direction is prevented, it is possible to use impellers with curved profiled blades, the efficiency of which is greater than that of the impellers with straight blades.

Moreover, it has been noted that the particular conformation of the blades, as described and illustrated above, allows for the reduction of the losses which occur due to the turbulences created during the rotation of the blades, in comparison to the usual centrifugal pumps.

The total efficiency significantly increases, thus permitting the construction of pumps and electro-pumps suitably powerful, but at the same time also compact.

These pumps and electro-pumps are extremely versatile thanks to the device which allows for the variation of the orientation of the suction flow of liquid with respect to that of the supply flow. The versatility is further increased thanks to the device which permits the regulation of the flow of the supplied liquid, thus enabling the use of the same electro-pump for different applications wherein different flows are required.

It is evident that any conceptually or functionally equivalent modification or variation falls inside the scope of the present invention.

In order to simplify the construction, the cylindrical wall 52 may be directly fixed to the motor casing 20, but eliminating the possibility of positioning the motor casing 20 in any direction with respect to the direction of the supply flow.

The cover 60 may be without the cylindrical wall 68 which can be fixed to the circular wall 22 of the motor casing 20. In this case, by considering that the motor casing 20, the cylindrical wall 52 and the cover 60 are in any case rotatable one respect to the other, the orientation of the suction flow of the liquid may be changed as you like, whereas the direction of the supply flow may be oriented at 0°, 90° or 270° and 180° with respect to the motor casing 20.

Finally, the number of blades may be both greater or less than 3.

The invention claimed is:

1. Centrifugal pump for liquids comprising an impeller chamber inside which a centrifugal impeller is rotatably mounted, said centrifugal impeller includes a hub from which a plurality of curved blades extend out, each of them delimited by two curved edges, said impeller chamber being defined by two circular side walls and a cylindrical wall, on one of said circular side walls and in an axial position there is a suction intake for the liquid to be pumped while, on the cylindrical wall there is an outlet for the liquid, characterized in that a tab extends from one curved edge of said curved blades on the side of the concavity of the blades and folded in the direction opposite to the blade with respect to a radial plane.

2. Centrifugal pump for liquids according to claim 1, characterized in that at least one uni-directional stopping element is made in the circular wall facing said folded tabs and interacts with said folded tabs so that, when the centrifugal impeller rotates in a direction, the folded tabs hit the uni-directional stopping element thus stopping themselves whereas, when the centrifugal impeller rotates in the opposite direction, the folded tabs pass over the stopping element, so allowing the rotation of the impeller in the correct direction.

3. Centrifugal pump for liquids according to claim 2, characterized in that said centrifugal impeller is mounted with a prefixed axial gap inside said impeller casing so that, as said impeller rotates, due to the axial component of the hydrodynamic thrust acting on the folded tabs, said centrifugal impeller detaches from said circular wall on which said unidirectional stopping element is made, thus avoiding any contact between the folded tabs and said uni-directional stopping element.

4. Centrifugal pump for liquids according to claim 3, characterized in that a radial tab extends radially and is interposed between said folded tab and said curved edge of each blade.

5. Centrifugal pump for liquids according to claim 4, characterized in that the joint line between said radial tab and said folded tab has two ends, a first end positioned on said hub and a second end positioned near the free end of the curved edge of the blades, so that said radial tab is tapered to a point at the free end of the curved edge of the blades.

6. Centrifugal pump for liquids according to claim 5, characterized in that said folded tab has a rectangular shape and a straight free edge parallel to and close to the circular side wall which it faces.

7. Centrifugal pump for liquids according to claim 1, characterized in that said at least one uni-directional stopping element is a projecting element having two different profiles so that, as the centrifugal impeller rotates and when the free edge of said folded tabs interacts with the first profile of said projecting element, the impeller is free to rotate, whereas, in the opposite direction, wherein the free edge of said folded tabs interacts with the second profile, the rotation is prevented.

8. Centrifugal pump for liquids according to claim 7, characterized in that said first profile of said projecting stopping element is a profile which gradually rises with respect to said circular side wall whereas, said second profile is essentially right-angled with respect to the circular side wall.

9. Centrifugal pump for liquids according to claim 1, characterized in that it comprises adjusting means for the liquid flow in order to regulate the amount of liquid which comes out from said outlet.

10. Centrifugal pump for liquids according to claim 9, characterized in that said adjusting means for the liquid flow comprise a cylindrical tang rotatably mounted inside said cylindrical wall of said impeller chamber, said cylindrical tang having at least one opening so that, when said cylindrical tang or said cylindrical wall rotate, the supply liquid is regulated from a maximum value when the opening of said cylindrical tang is positioned at the outlet made in said cylindrical wall, to a zero value when the cylindrical tang completely closes the outlet.

11. Centrifugal pump for liquids according to claim 10, characterized in that said cylindrical tag is integral with one of said circular side wall, so that by rotating said circular side wall the supply flow is regulated.

12. Centrifugal pump for liquids according to claim 11, characterized in that a cup is mounted on the circular side wall where the suction intake is made, it covers said suction intake and has an opening radially arranged so that, by rotating said circular side wall the orientation of the suction flow of liquid changes.

13. Centrifugal pump for liquids according to claim 12, characterized in that said cylindrical wall is rotatable so that, by rotating said cylindrical wall the orientation of the supply flow of liquid is changed.

14. Centrifugal pump for liquids according to claim 13, characterized in that said cylindrical tag is fixed to the circular side wall on which the cup his mounted.

15. Centrifugal pump for liquids according to claim 14, characterized in that three openings are made in said cylindrical tag which are essentially arranged at 90° so that, by rotating the circular side wall, on which the cup is mounted, with respect to the cylindrical wall, three positions are defined wherein the opening of said cylindrical tag is positioned at the outlet, so that the suction flow is oriented with respect to the supply flow at 0°, 90° or 270°, and 180°, and in each of said positions the supply flow can be regulated by rotating said circular side wall with respect to said cylindrical wall.

16. Centrifugal pump for liquids according to claim 1, characterized in that the number of the blades is equal or greater than 3.

17. Centrifugal electro-pump, characterized in that it comprises an electric motor coupled to a centrifugal pump according to claim 1.

18. Centrifugal electro-pump according to claim 17, characterized in that said electric motor is a synchronous electric motor.

19. Centrifugal electro-pump according to claim 18, characterized in that said synchronous electric motor comprises a stator made up of an electro-magnet and a rotor made up of a permanent magnet axially and integrally coupled with the hub of said centrifugal impeller.

20. Centrifugal electro-pump according to claim 1, characterized in that said rotor or permanent magnet is mounted with a prefixed gap inside said motor casing and in the rest position, wherein the electric motor is off and the centrifugal impeller does not rotate, the rotor is centrally positioned with respect to the stator due to the residual electro-magnetism and the folded tab are in contact with said circular wall of the motor casing, so as to assure the correct starting of the centrifugal impeller.

21. Impeller for centrifugal pumps, characterized in that it comprises the characteristics claimed in claim 1.

* * * * *